US006095069A

United States Patent [19]

Tadzhibaev

[11] Patent Number: 6,095,069

[45] Date of Patent: Aug. 1, 2000

[54] DOUBLE-THREAD CHAIN-STITCH SEWING MACHINE

[76] Inventor: Zarif Sharifovich Tadzhibaev, TS-13, d.14, kv. 1, 700128 Tashkent, Uzbekistan

[21] Appl. No.: 08/849,778

[22] PCT Filed: Nov. 21, 1995

[86] PCT No.: PCT/UZ95/00001

§ 371 Date: May 22, 1997

§ 102(e) Date: May 22, 1997

[87] PCT Pub. No.: WO96/16219

PCT Pub. Date: Mar. 30, 1996

[30] Foreign Application Priority Data

Nov. 23, 1994 [UZ] Uzbekistan ..... IHDP 9401016.1

[51] Int. Cl.[7] ..... D05B 1/10; D05B 57/04; D05B 47/00

[52] U.S. Cl. ..... 112/201; 112/254

[58] Field of Search ..... 112/254, 201, 112/194, 187, 34, 53, 199, 255

[56] References Cited

U.S. PATENT DOCUMENTS

| | | | |
|---|---|---|---|
| 1,327,232 | 1/1920 | Gatchell | 112/254 |
| 4,169,422 | 10/1979 | Hayes et al. | 112/201 |
| 5,233,936 | 8/1993 | Bellio | 112/197 X |
| 5,487,347 | 1/1996 | Kogawara | 112/254 X |

*Primary Examiner*—Ismael Izaguirre
*Attorney, Agent, or Firm*—Ilya Zborovsky

[57] ABSTRACT

A double thread chain-stitch sewing machine with a platform containing a needle, a needle plate with a slot, a pressing leg, a looper and a toothed rack for transporting a material, characterized in that it additionally has autonomous disk-shaped cam thread tensioners for a top and a bottom thread and a pusher for the bottom thread installed with the possibility of executing an oscillating movement around its axis, and the looper is installed with the possibility of executing a rotary movement in a vertical plane, parallel to the stitch line and with the possibility of performing two revolutions per one cycle of movement of the needle and the pusher.

4 Claims, 7 Drawing Sheets

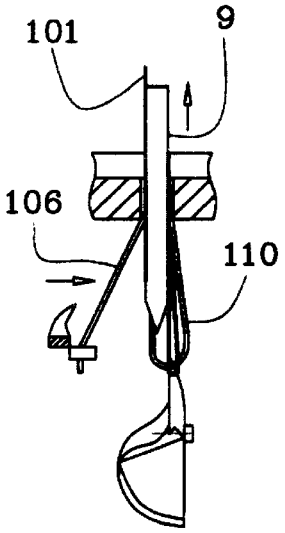
FIG.12a
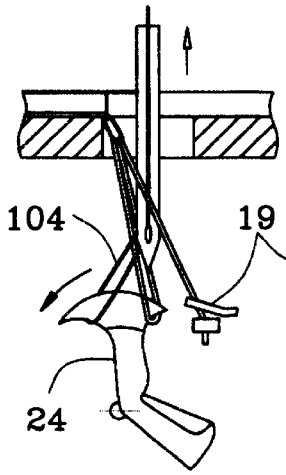
FIG.12b
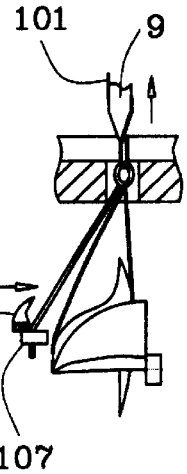
FIG.13a
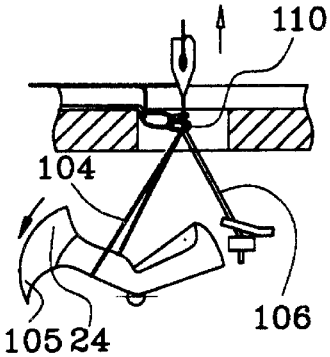
FIG.13b
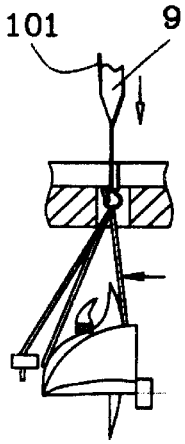
FIG.14a
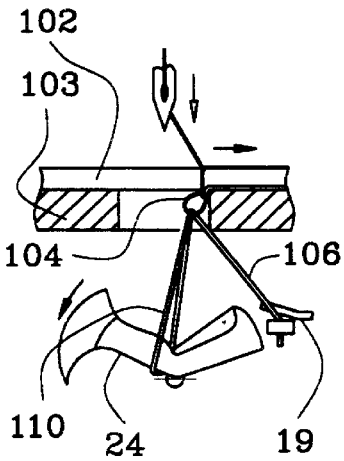
FIG.14b
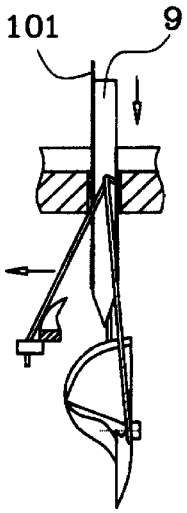
FIG.15a
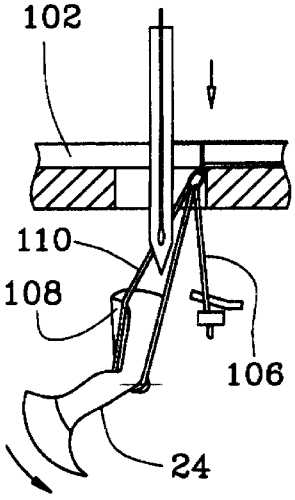
FIG.15.b

DOUBLE-THREAD CHAIN-STITCH SEWING MACHINE

BACKGROUND OF THE INVENTION

The invention relates to manufacture of equipment for sewing, sewing industry, knitted goods industry, leather industry, and shoe industry, in particular shoe double-thread chain-stitch sewing machines.

A sewing machine is known which makes a double-thread stitch line of the type 401 (see Reibarkh L. B., Reibarkh L. P., Dremalin N. A. "Sewing Machines for Knitting & Textile Industry", M., "Legprombitizdat", 1989, pages 33–56), which is formed with a needle and one looper with needles in them, in which the looper performs a complicated spacial movement including an oscillating movement transversely to the line of stitch in a vertical plane and a reciprocating movement along the line of stitch in a horizontal plane.

The formation of a stitch is performed in the following sequence. A needle with a top thread pierces through a material and passes through it a loop of the top thread. During lifting of the needle from its extreme lower position above its ear a loop-overlap of the top thread is formed, and the looper is inserted with its nose into the loop-overlap during its oscillating movement through the left in the vertical plane. The loop engages the top thread. During a further movement through the left, the loop expands the loop of the top thread, introduces into it a loop of the bottom thread and deviates in a direction, which is opposite to the direction of movement of the material, by a value which insures the position of the looper before the needle. The needle lifts and leaves the loop of the top thread on the looper, it exits the material and starts lowering when it reaches an extreme top position. During the location of the needle outside the material, the material is displaced by the value of the stitch. The needle during a second lowering pierces the material and passes the loop of the top needle through it. At this time the looper must start its movement to the right so that on the one hand it provides the positioning of the loop of the top thread fitted on it at the right side of the needle, and at the other end the lower thread of the looper remains still at the left side of the needle. Therefore under the needle a kind of a triangle with an apex in the point of the preceding piercing end sides composed of the top needle, lower needle and the body of the looper is formed. The needle must reach (pierce) in the area of this triangle, since otherwise the stitch is missing. After piercing the needle continuous lowering and passes the loop of the top needle through the loop of the bottom needle. The looper during the movement to the right throws the loop of the top thread to the lower thread of the looper. The loop of the top thread which is thrown from the looper is reduced by a lowering needle, and a preliminary tightening of the stitch by the needle is performed, while the looper continues its movement to the extreme right position and deviates also in direction of movement of the material. The needle reaches its extreme bottom position, and then lifts so as to form a loop-overlap of the upper thread, and the looper engages it during movement. The final tightening of the stitches performed by joint action of the looper and mechanism of movement of the material.

In the above mentioned machine, the mechanism of the looper is complicated in the sense of construction, and also the stability of operation of the machine requires a great area of the triangle, which depends from manufactures. Moreover, the formation of the stitch, or in other words weaving by the top and bottom threads though occurs over one revolution of the main shaft, but the final tightening of the stitch is performed not immediately, but at the second-third cycle depending on a thickness, physics-mechanical properties of the material, a pitch of the stitch and required value of tightening of the stitch with the participation of practically all working units of the machine. The produced stitch is easily unraveled from the end under a relatively low load applied to the bottom thread, which negatively affects a quality of the stitch.

Also, a sewing machine is known, which makes a double-thread stitch line of the type 401 with an increased spreading of the stitch (see Polukhin V. P., Reibarkh L. B. "Stitch line sewing machines of foreign firms", M., "Light industry", 197, pages 114–163).

The working units of the machines are: a needle, a looper, an expander, a toothed rack for moving of the material, a pressing leg, a needle plate with a slot, cutters for cutting of threads, and a device for supplying threads. In contrast to the previous machine, also the expander participates in the process of loop-forming and it moves in a horizontal plane. It contributes to the formation of a stable triangle of threads, pulling the bottom thread of the looper and a branch of the top needle thread in direction of movement of the material. In addition to this, the machine also fixes the stitches by a reverse seam. Both during the direct as well as the reverse movement of the material, due to the pulling by the expander of the bottom and top threads, a stable triangle is formed between the looper, its lower thread, and the loop of the upper needle thread. In order to improve tightening of the stitch during the reverse movement of the material, an additional regulator for tightening of the top thread is installed on the machine, and it is activated only during the reverse movement of the material. The structure of the stitches obtained on the machine is different from the structure of common double-thread stitch lines of the type 401, in that the loop of the upper needle thread extends along the line in direction toward a next stitch. Such a line has an increased spreading up to 60%, and therefore the machine is used in a leather goods industry and sewing industry for processing of materials having an increased elasticity.

However in this machine the mechanism of looper is complicated in the structural sense. The participation of the expander in the process of forming of the stitch also complicates the construction of the machine. Moreover, the fixation of the line with a reverse seam which is performed with the use of additional devices does not provide a complete non-unraveling of the line from the end, but only complicates the unraveling of the line. The formation and tightening of the stitch is performed during the second-third cycle with participation of actually all working units of the machine, which reduces the reliability of the operation.

SUMMARY OF THE INVENTION

The objective of the invention is a simplification of the construction, an increase of efficiency of the sewing machine, as well as an increase of the quality of line by its non-unraveling from the end. This objective is solved in that a double-thread stitch line sewing machine with a flat or columnar, or cylindrical platform, containing a needle, a needle plate with a slot, a pressing leg, a looper and a toothed rack for moving the material, additionally has autonomous disk-shaped cam thread tighteners for the top and bottom threads and a pusher for the lower thread, arranged so that it can execute an oscillalting movement around its axis, and the rotatable looper is arranged so that it can execute rotation in a vertical plane, parallel to the stitch line so as to perform two revolutions per one cycle of movement of the needle and the pusher.

The user in the invention of the looper which executes the rotary movement in the vertical plane parallel to the stitch line leads to a double thread chain-stitch sewing machine with a simpler mechanism as well as to a productivity increase. Moreover, the uses of the looper which executes the rotary movement makes unnecessary the use in the double-thread chain-stitch sewing machines which perform sewing in a straight direction and in an opposite direction, of an additional working unit-expander, which simplifies the construction of the machine.

The introduction in the machine, in accordance with the invention, of two autonomous disk-shaped cam thread tighteners for the top and bottom threads makes possible obtaining of the formed finished stitch in one cycle. The disk shaped cam thread tightener for the top thread supplies the top thread to the needle and looper, removes the loop of the top thread from a heel of the looper, executes tightening of the formed stitch, and unwinds a next portion of thread from the reel. The disk-shaped cam thread tightener for the lower thread performs the same functions than the lower thread as the disk-shaped cam thread tightener for the upper thread, distinguished in that at the initial stage the lower thread is supplied to the pusher.

As a result the obtained double-thread chain line, after cutting off of the top and bottom threads, does not unravel at the end of the sewing process from the end of the line, since the branch of the bottom thread becomes surrounded by the loop of the top thread, and this in turn increases the quality of the lines of the double-thread chain stitch on the articles. The obtained line differs from the structure of conventional double-thread chain stitches of the type 401 in that the loop of the top thread is extended along the line in direction toward a next stitch, and also by the turned loops of the top and bottom thread by 180°.

The use of the invention makes possible the creation of sewing machines with double-thread chain stitch based on the existing shuttle sewing machines.

BRIEF DESCRIPTION OF THE DRAWINGS

FIGS. 4*a*–4*b*—FIGS. 13*a*–13*b* are successive diagrams of the location of working units of the machine in a process of formation of a stitch with a straight movement of the material. On the drawings, the reference "a" shows types in a vertical plane parallel to the stitch line. On the drawings, reference "b" shows corresponding use from the left in the plane perpendicular to the stitch line.

FIGS. 14*a*–14*b*—FIGS. 17*a*–17*b* show processes of stitch formation during a reverse movement of the material. On the drawings, reference "a" shows views in vertical plane which is parallel to the stitch line. On the drawings, reference "b" shows corresponding views from the left in the plane perpendicular to the stitch line.

The developed sewing machine (FIG. 1) has the following working units.

Figure 4A:
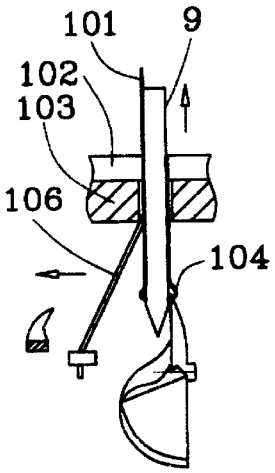
Figure 4B:
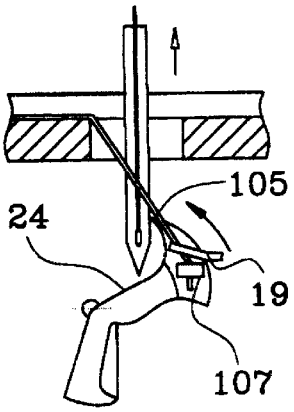

A needle 9, a looper 24, a pusher 19, a tooth rack 39, a pressing leg 62, disk-shaped cam thread tighteners for a top 11 and a bottom 28 thread, as well as a needle plate 103 (FIG. 4*a*, FIG. 4*b*) with a slot.

DESCRIPTION OF PREFERRED EMBODIMENTS

In accordance with the first embodiment of the invention, in a sewing machine which has a flat platform, the working mechanisms are moved during a rotation of a fly wheel 1 (FIG. 1) arranged on a main shaft 2, in clockwise direction. A fixing screw fixes a crank 3 with a counter weight on the left end of the main shaft 2, and a pin 4 is inserted in its opening and fixed by a stopping and setting screws. An upper head of a connecting rod 5 is placed on the pin 4, while a lower head of the connecting rod is placed on a pin of a carrier 6, in which a needle drive 7 is fixed by a clamping screw. A slider 8 is placed from the right side onto the pin of the carrier 6 and introduced into a slot of a guide. The needle drive 7 is moved in two bushings. A needle 9 is fixed in the needle drive 7 from below with a starting screw.

A disk-shaped cam thread tightener 11 for the top thread is fixed on the left end of the pin 4 by a stopping screw 10. The disk-shaped cam thread tightener 11 is formed by two disk-shaped cams which are mounted on a bushing. The disks are introduced into a window of a controlled cantilever (not shown in FIG. 1), which is fixed to a head of the machine. A fork 12 is maintained in a horizontal position in the center of the window of the cantilever and also between two cams and its prongs are fixed through struts to the cantilever. Regulated thread guides 13, 14 are mounted on the cantilever at different sides of the fork 12.

When the top thread is introduced through the disk-shaped cam thread tensioner 11, the top thread first is introduced into the right thread guide 13, and then between the forks 12 into the left thread guide 14 also. All these thread guides and forks are necessary for the accurate fixation of the top thread during the period of its interaction with the rotatable disk-shaped cam thread tightener. The timely supply of the top thread and tensioning of the stitch is regulated by turning of the disk-shaped cam thread tensioner 11 after loosening of the screw 10.

The rotary movement is transmitted to a distributing shaft 15 from the main shaft 2 through toothed drums 17, 16 and a toothed belt 18 with a transmission ratio $i_1$=1:1.

A pusher 19 of the bottom thread executes an oscillalting movement in a horizontal plane, since it obtains movement from the crank distributing shaft 15 through a spacial four-link structure, so as to perform one cycle per one revolution of the main shaft 2. A cylindrical tail part of the pusher 19 is fixed in an end opening of the upper part of a shaft of a holder 20 by a stopping screw so that the movement of the pusher 19 can be regulated as to its height, and also around the shaft of the holder 20. Moreover, the pusher 19 can be regulated along its length. The oscillalting movement of the shaft of the holder 20 with the pusher 19 is transferred from a knee of the distributing shaft 15 through a spherical connecting rod 21, a spherical finger 22, and a carrier 23 which is fixed by a clamping screw on the shaft 20.

The looper 24 rotates in a vertical plane which is parallel to the stitch line and executes two revolutions per one revolution of the main shaft 2. The looper mechanism provides a uniform rotation of the looper 24 in a direction which is opposite to the rotation of the main shaft 2. The mechanism includes two cylindrical gears 25 and 26 with a ratio $i_2$=2:1, a crank distributing shaft 15 and a looper shaft 27. A cylindrical tale of the looper 24 is fixed in an end opening in the left part of the shaft 27 by a screw. A gap between the needle 9 and a nose of the looper 24 is regulated by a displacement of the looper in the opening of the shaft 27 during loosening of the stopping screw. The mutual location of the pusher 19 relative to the looper 24 is regulated by turning of the crank distributing shaft 15 with loosened screws of one of the gears 25 and 26.

The time when the nose of the looper 24 approaches the needle 9 is regulated by turning of the main shaft 2 relative to the shaft 15 with loosening of the fixing screw of the lower toothed drum 17.

A disk-shaped cam thread tensioner 28 for the bottom thread is fixed by a starting screw on the shaft 15. The disk-shaped cam thread-tensioners for the top and bottom threads have different geometric sizes and shapes of the cams.

The mechanism of material movement is analogous to the corresponding mechanism of the shuttle sewing machine of 97-A class (CISAEV V. V., Frants V. Y. "Design, setting and repair of sewing machines", M., "Light industry", pages 44–58).

The mechanism is composed of the following units: A unit for vertical and horizontal movements of a rack, a device of a regulator of stitch length and reverse feed. A double cam is fixed on the distributing shaft 15 by two screws. A rear head of the connecting rod 30 is fitted on the right part 29 of the eccentric for vertical movement of the rack. The front head of the connecting rod 30 is connected by a hinge conical screw 31 with a lever 32. The lever 32 is fixed by a stopping screw on a shaft 33 for rack lifting, which is held in two centering pins 34 and 35. The lever 36 is made of one piece with the shaft 33, and a slider 37 introduced into a fork of a lever 38 of the material transporting mechanism is fitted on its finger. A toothed rack 39 is fixed to the lever 38 by two screws.

A front head of the connecting rod 41 is fitted on the left part 40 of the cam for horizontal movement of the rack. The rear head of the connecting rod 41 is formed as a fork and fitted on an axial 42 which is fixed by a screw in a connecting link 43. A fork head of a second connecting rod 44 is fitted on the same axial 42. The rear head of the connecting rod 44 is connected with a lever 45 by a hinge screw. The lever 45 is fixed on a shaft 46 of a material transporting mechanism by a screw. The shaft 46 is held in two centering pins 47 and 48. A frame 49 is formed of one piece with the shaft 46, and a lever 30 of the material transporting mechanism is held by screws in its two centering pins 50 and 51.

The lower head of the link 43 and a supporting link 53 are fitted on an axial 52 in a unit of a stitch length regulator and material transportation direction change, and a lever 54 is fixed by a screw on the axial 52. The upper head of the supporting link 53 is fitted on the hinge pin. The lever 54 is fixed a screw on a shaft 55 which is held in two bushings. A spring is fitted on the shaft 55, and a setting ring fixed by a screw on the shaft. A lever 56 is pressed at the right side on the shaft 55, and it is connected by a lever 58 of a stitch length regulator by a link 57. The lever 58 is fitted on a hinge pin 59 inserted in an opening of machine sleeve stand and fixed by a screw. The lever 58 has a cylindrical surface which passes into a slot of the machine sleeve stand, and a nut 60 with a handle 61 are screwed on its end. The stitch length is regulated by a turning of the nut 60 while the reverse fit of the material is regulated by pressing of the lever 61 downwardly.

The engagement between the two rack 39 and the material which is necessary for its transportation is provided by a pressing leg 62. The pressing leg 62 is fixed on a vertical pin 63 mounted in a bushing of the front part of the machine behind the needle driver 7. A carrier 64 is fixed on the upper end of the pin and its tale is introduced into a vertical guiding slot, so as to prevent the pin 63 with the pressing leg 62 from turning about its axis. Pressing of the pressing leg 62 against the needle plate is performed by spring 65 and is regulated by a screw 66. In order to provide a manual lifting of the pressing lift 62, a lever 67 is utilized, so that the carrier 68 abuts against the lever and is lifted so as to urge the pin 63 to be lifted together with the pressing leg 62. In addition, the unit of the pressing leg has a device for a foot lifting of the pressing leg 62 (not shown in FIG. 1). During lifting of the pressing leg 62, a special device (not shown in FIG. 1) acts on the brake disks of the tensioning regulator, so as to release the top thread and to allow removal of the article from under the needle of the machine.

Based on the sewing machine with the flat platform, the sewing machine of double-thread stitch line with a columnar platform is developed, which is characterized by the platform under the needle of the column. In accordance with the second embodiment of the invention, the column accommodates the loop 24, the toothed rack 39, and the pusher 19, as well as transmission parts of these units.

Figure 2:
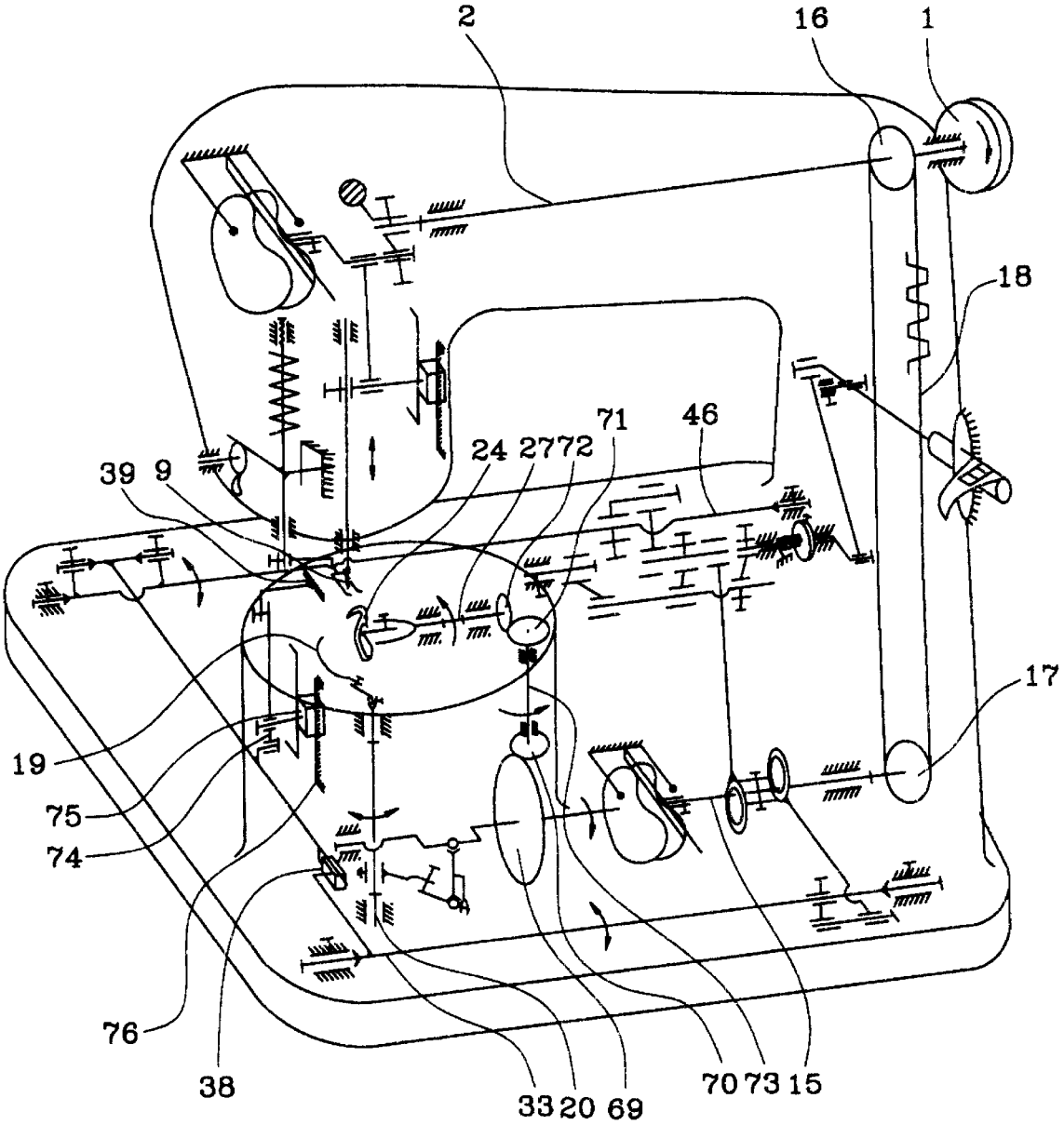
FIG. 2 shows a kinematic diagram of a machine with a columnar platform.

The crank distributing shaft 15 (FIG. 2) obtains the rotary movement from the main shaft 2 through toothed drums 16, 17 and toothed belt 18 with a transmission ratio $i_1$=1:1.

The looper mechanism provides a uniform rotation of the looper 24 (FIG. 2) in a direction, opposite to the rotation of the main shaft 2. The mechanism includes two pairs of conical gears 69, 70 with a transmission ratio $i_2$=2:1, and 71, 72 with a transmission ratio $i_3$=1:1, a vertical shaft 73 and a looper shaft 27.

The mechanism of the pusher 19 (FIG. 2) has an elongated holder 20 depending on the height of the column. The Mitchell position of the pusher 19 relative to the looper 24 is regulated by turning of the shaft 15 with loosened screws fixing the conical gear 69.

The fork of the lever 38 (FIG. 2) of the material transporting mechanism is not a rack-shape, but serves only for starting the movement of a rod 74 mounted in the column. The tale part of the toothed rack 39 is fixed to the upper rod 74 by two screws. The rod 74 during the operation executes an oscillalting movement under the action of the shaft 46 for horizontal movements, and in addition it is lifted and lowered in a vertical direction under the action of the 33 for vertical movements. The movement of the rod 74 in a vertical direction is provided by stone 74 and a guide 76 in the column. The toothed rack 39 connected with the rod 74 repeats its movement.

Based on the sewing machine with the flat platform, a sewing machine of double-thread stitch line with a cylindrical platform is developed, which has some structural changes, determined by the shape of the platform.

The mechanisms of longitudinal movement of the toothed rack, the regulator of the stitch length, and also of changes in material transportation direction are analogous to the corresponding mechanisms of a shuttle sewing machine of the class 22-A (see Chervyakov F. I., Sumarokov N. V. "Sewing machines" M. "Mashinostroenie", 1968, pages 144–147).

Figure 3:
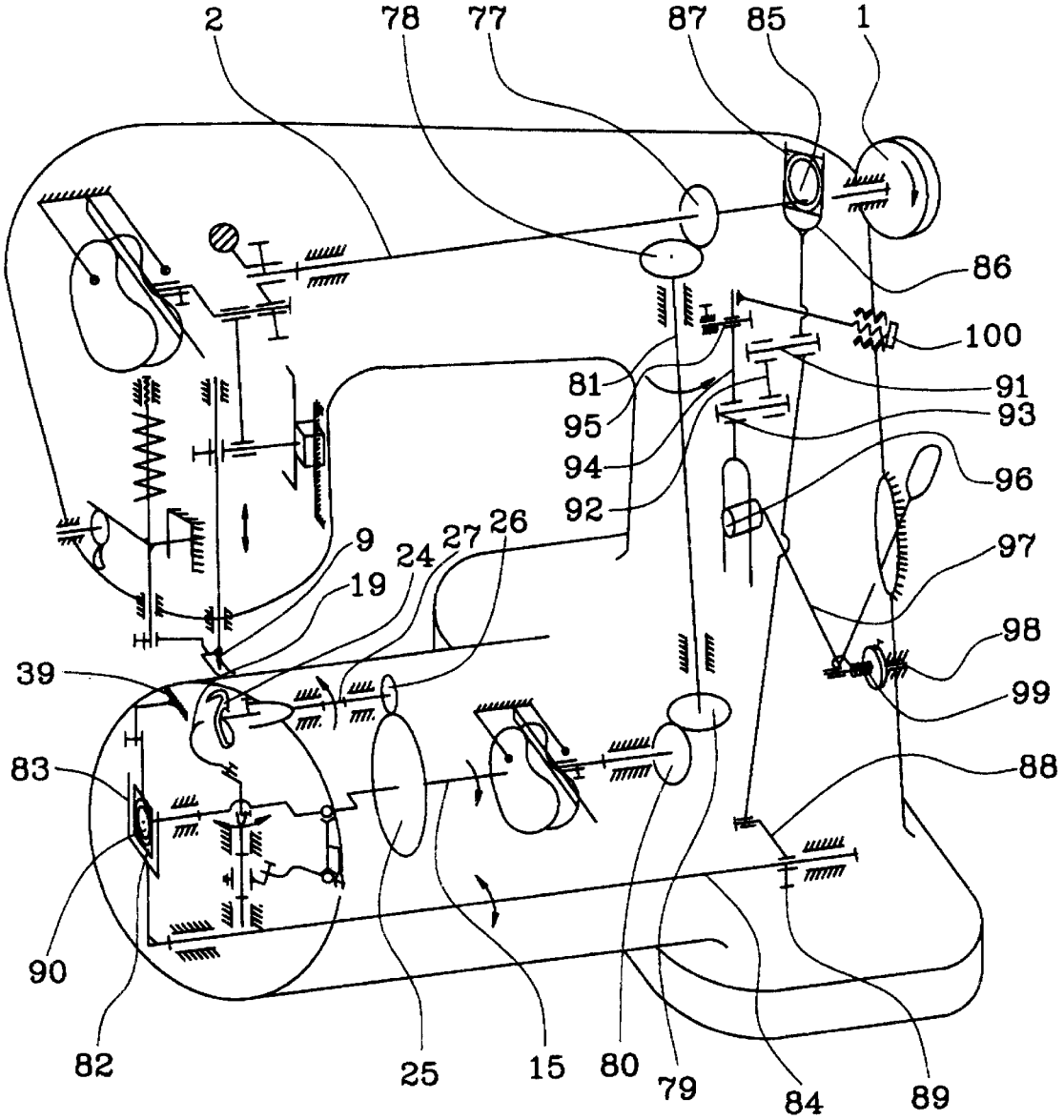
FIG. 3 shows a kinematic diagram of a machine with a cylindrical platform.

In accordance with the third embodiment of the invention, the crank distributing shaft 15, (FIG. 3) obtains the rotary movement from the main shaft 2 through two pairs of conical gears 77, 78 and 79, 80 with a common transmission ratio I comb equals 1:1 and a vertical shaft 81.

The toothed rack 39 is fixed by two screws to a slider 82 (FIG. 3) inserted into a fork 83 which is a front lever of a pushing shaft 84. A cam 85 is a leading link of the pushing shaft 84 and fixed on the main shaft 2 of the machine. A fork 86 embraces with its prongs an intermediate part-seal 87 fitted on an eccentric 84. During the operation of the mechanism, the fork prongs slide along lateral guide sides of the seal. The lower head of the fork 86 is connected by a hinge screw with a lever 88 fixed by a screw 89 on the pushing shaft for fitting 84.

During rotation of the main shaft 2, its cam 85 and seal 87 through the fork 86 and the lever 88 impart reciprocal movements to the shaft 84 and the fork lever 83. Together with the latter, the slider 82 and the toothed rack 89 are moved, and its working movement along an arc corresponds to the shape of the platform. The movements along a vertical line of the slider 82 and the toothed rack 89 is provided by a cam 90 which is fixed on the end of the crank distributing shaft 15 and located inside the slider 82. The height of lifting of the rack teeth is regulated by displacement of the rack itself along a vertical line.

In order to regulate the stitch length and the change of material transportation direction, a connecting link 92 is connected with the fork 86 (FIG. 3) by a conical hinge screw 91 and nut, and it is connected by a hinge 93 with a central part of a lever 24 for line regulations. The lever 94 is connected by a hinge screw 95 with a machine sleeve. A roller 96 of the lever 97 for feed stitching is inserted to a mouth of the lever fork 94. The lever 97 is connected in its central part to the machine sleeve by a hinge screw 98. A second outer arm of the lever 97 extends outwardly through a sleeve slot. A strong spring 99 is fitted on the fork of the lever 96 and urges to turn the lever 96 in counter clockwise direction. A screw of the regulator 100 abuts with its conical tale into a projection of the lever 94 and fixes the hinge 93 in a predetermined position. An angle of rolling of the bushing shaft 84 and therefore a line pitch will depend from the position of the hinge 93. When the lever 97 is lowered downwardly, a reverse material movement is performed.

The process of formation of double-thread chain stitch with the rotatable looper 24 during a straight movement of the material is performed in the following manner.

The needle 9 (FIG. 4*a*, 4*b*) with a top thread 101 piercing a material 102, passes the thread through it, and also through a slot of the needle plate 103. During lifting of the needle 9 from the extreme low position, above the ear of the needle a loop-overlap 104 of the top thread 101 is formed, and a nose 105 of the looper 24 is introduced into it at the beginning of its first turn in a first cycle. During this step, a bottom thread 106, after passing through the disk-shape cam thread tensioner 28 (FIG. 1) is moved through the thread guide 107 located in a first quadrant of the secular trajectory of the nose 105 of the looper 24 into a slot of the needle plate 103 with the passage of the end of the bottom thread 106 onto the upper surface of the plate.

Figure 5A:
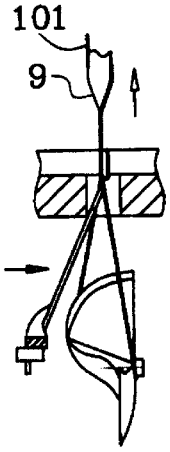
Figure 5B:
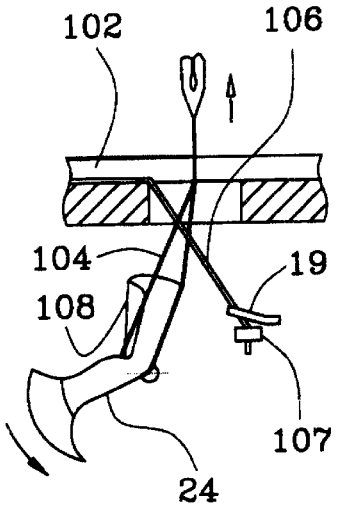

During the further movement on the first turn, the looper 24 (FIG. 5*a*, FIG. 5*b*) expands the cut loop-overlap 104 of the top thread 101, and it slides off toward the rotary axis of the looper 24. Then, the tail with an inclined surface 108 of the looper 24 approaches from behind of both branches of the loop-overlap 104 and starts turning them relative to the initial position by 180°. The pusher 19 starts to feed the bottom thread 106 by passing above the thread guide 107 into the zone of movement of the nose 105 of the looper 24 across the plane of rotation of the latter. The end part of the pusher 19 is inclined from the horizontal plane upwardly by a predetermine angle selected so that the bottom thread 106 after the end of the feet easily slips off from the end part of the latter. Since the front part of the pusher 19 has a wedge-like shape, the lower thread 106 does not slip off from it during the feed of the latter. The rear part of the pusher 19 has a convex arcuate shape, so that the pusher 19 during its reverse movement and passage above the thread guide 107 passes through the branch of the bottom thread 106 located between the material 102 and the thread guide 107 so as not to engage the latter. During the stitch forming, the lower thread 106 must be located at the left side in a tensioned condition, for each purpose the regulator for tensioning of the bottom thread has a compensating spring (not shown) the needle 9 with the top thread 101 continues to lift upwardly.

Figure 1:
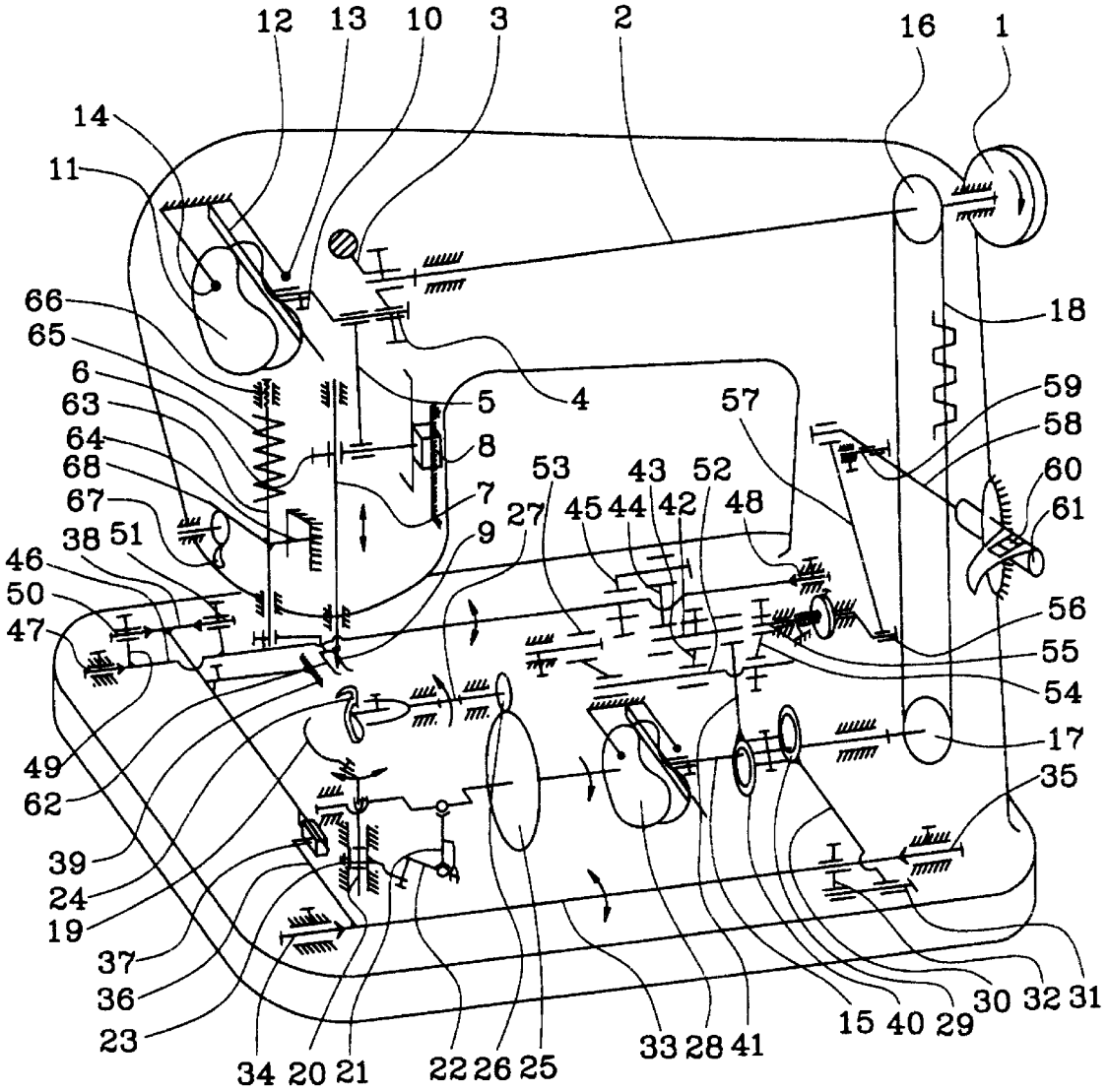
FIG. 1 shows a kinematic diagram of a machine with a flat platform.
Figure 6A:
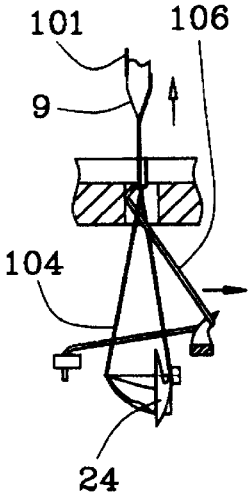
Figure 6B:
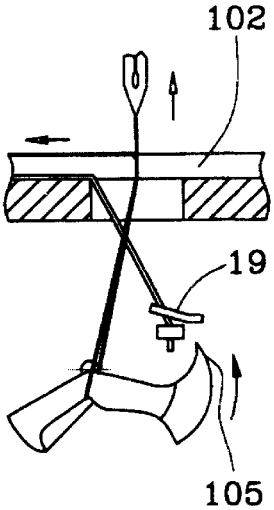

During further rotation over the first revolution the looper 24 (FIG. 6*a*, FIG. 6*b*) finishes turning of the loop-overlap 104 by 180°, and it passes therefore the looper 24 outside so as not to intersect its axis of rotation. The pusher 19 continues feeding of the bottom thread 106 to the nose 105 of the looper 24 so as to intersect the plane of rotation of the latter. With this, the required quantity of the bottom thread 106 is supplied to the pusher 19 by the disk-shaped cam thread tensioner 28 (FIG. 1). The needle 9 with the top thread 101 continues to lift upwardly and also transportation of the material 102 starts.

Figure 7A:
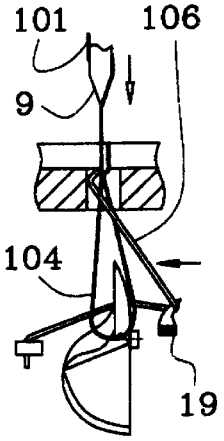
Figure 7B:
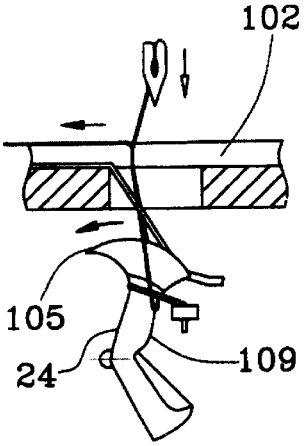

At the end of the first revolution, the looper 24 (FIG. 7*a*, FIG. 7*b*) engages the bottom thread 106. After insignificant turning of the looper 24, the nose 105 enters the loop-overlap 104 of the top thread 101 which is held by the heel 109 of the looper 24. After this, the rotation of the looper 24 removes the loop-overlap 104 from the heel 109, and the pusher 19 performs movement in a reverse direction. The needle 9 with the top thread 101 after its top position starts lowering downwardly, and the transportation of the material 102 continues.

Figure 8A:
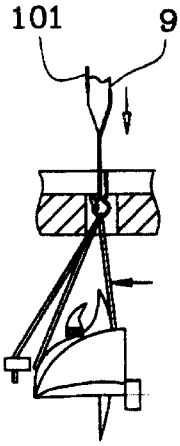
Figure 8B:
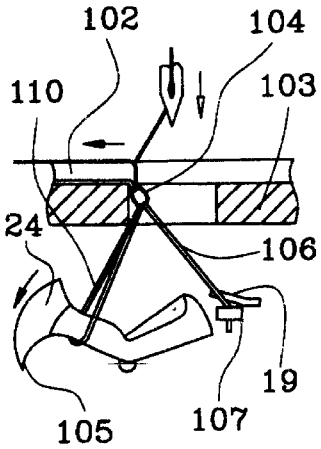

During further rotation over the second revolution, the looper 24 (FIG. 8*a*, FIG. 8*b*) moves the bottom thread 106 from the front part of the pusher 19 which is moving in the opposite direction. Thereby the bottom thread 106 is engaged only by the body 24 which is passes the bottom thread 106 into the loop-overlap 104 of the top thread 101 thrown from the heel 109 of the looper 24. The thrown off loop-overlap 104 of the top thread 101 reduces and is tied by the disk-shaped cam thread tensioner 11 (FIG. 1). In the last moment, the top thread 101 is wound off from the reel for the new stitch, and simultaneously the transportation of the material 102 ends until piercing of the material by the needle 9. At this point, the ends of both branches of the bottom thread 106, engage by the looper 24, are lifted to the material 102 by the loop overlap 104 of the top thread 101 so as to impart to them the shape of the loop 110 which is needed for leading it around the looper 24. In addition to it, the needle plate 103 which has a longitudinal slot parallel to the plane of rotation of the nose 105 of the looper 24, holds the branch of the bottom thread 106 located between the needle guide 107 and the material 102 in the zone of movement of the pusher 19.

Figure 9A:
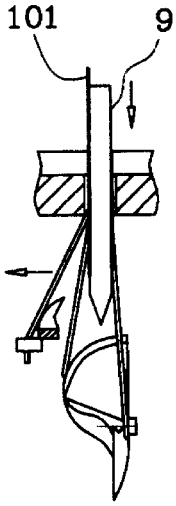
Figure 9B:
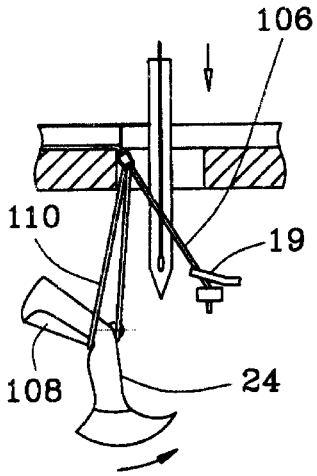

After this, during the second revolution of rotation of the looper 24 (FIG. 9*a*, FIG. 9*b*) the needle 9 with the top thread 101 again pierces through the material 102 and passes through it the top thread 101 and is lowered more to the right from the loop 110 of the bottom thread 106. During this process, the looper 24 expands and turns the loop 110 of the bottom thread 106 by 180°, as well as the loop 104 of the top thread 101.

Figure 10A:
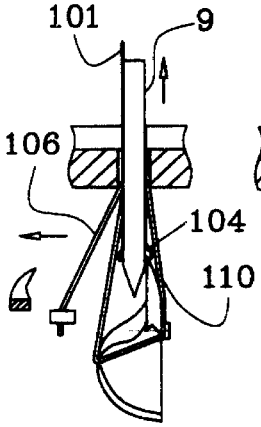
Figure 10B:
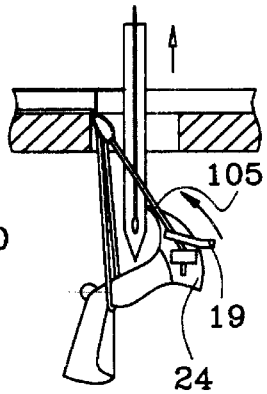

During further rotation of the looper 24 (FIG. 10*a*, FIG. 10*b*) at the end of the second revolution, the needle 9 with the top thread 101 is lifted from its extreme lower position and forms a next loop-overlap 104, into which the nose 105 of the looper 24 enters.

Figure 11A:
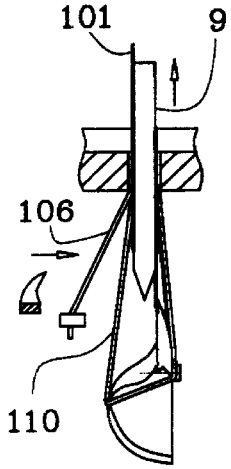
Figure 11B:
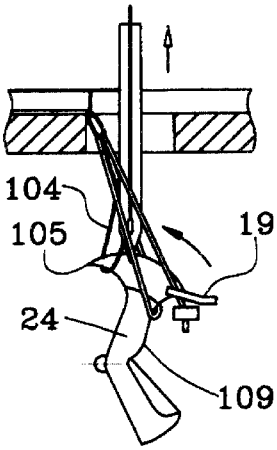

In the beginning of the first revolution of the second cycle of rotation of the looper 24 (FIG. 11*a*, FIG. 11*b*) the nose 105 of the latter enters the loop 110 of the bottom thread 106 which is held by the heel 109 of the looper 24. Then by rotation of the looper 24, the loop 110 is thrown off from it. The loop-overlap 104 of the bottom thread 101, engage by the looper 24, is passed by the body of the looper 24 into the thrown off loop 110 of the bottom thread 106, which is reduced by the disk-shaped cam thread tensioner 28 (FIG. 1).

During further rotation, in the first revolution of the second cycle, the looper 24 (FIG. 12*a*, FIG. 12*b*) expands the engaged loop-overlap 104 of the cup thread 101, and the reduction of the thrown off loop 110 of the bottom thread 106 by the disk-shaped cam needle tensioner 28 continues, while the needle 9 with the top thread 101 continues to lift upwardly.

The looper 24 (FIG. 13*a*, FIG. 13*b*) over the first revolution of the second cycle during its further turning, continues to expand the loop-overlap 104 of the top thread 101. After the reduction of the loop 110 of the bottom thread 106, the tightening of the stitch by the disk-shaped cam thread tensioner 28 (FIG. 1) is executed. At the last moment, the bottom thread 106 is wound off from the reel for a new stitch. Then the process of formation of the stitch is repeated.

The process of formation of the stitch during the reverse movement of the material is executed in the following manner. In this case the loop 110 of the bottom thread 106 is deviated to the right relative to the line of movement of the needle 9 (FIG. 14*a*, FIG. 14*b*).

During a further turning of the looper 24 (FIG. 15*a*, FIG. 15*b*) the needle 9 with the top thread 101 pierces the material 102 and lower between the branches of the loop 110 of the bottom thread 106 from the left side.

Figure 16A:
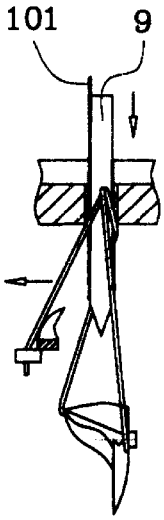
Figure 16B:
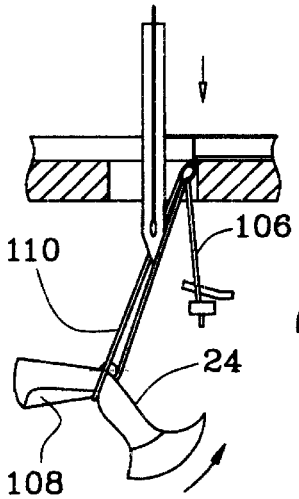

Then, after the substantially lowering of the needle 9 from the surface of the needle plate 103, the tale of the looper 24 approaches with its inclined surface 108 the loop 110 of the bottom thread 106 from behind and starts turning the thread. After this, after the final turning of the loop 110 of the bottom thread 106 (FIG. 16*a*, FIG. 16*b*) by 180°, the needle 9 with the top thread 101 is located at the right side, or in other words in front of the loop 110 of the bottom thread 106.

Figure 17A:
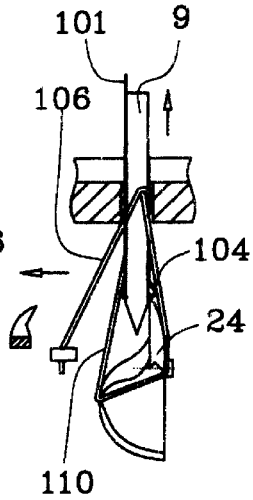
Figure 17B:
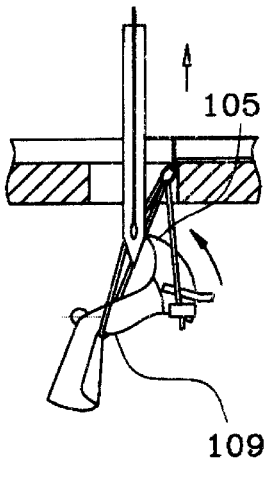

During lifting of the needle 19 (FIG. 17*a*, FIG. 17*b*) from the extreme lower position, the loop-overlap 104 of the top thread 101 is formed above the ear of the needle, and the nose 105 of the looper 24 enters it, and after an insignificant turning of the looper 24, the nose 105 enters the loop 110 of the bottom thread 106, after which the throwing off of the loop 110 by the bottom thread 106 occurs.

The remaining processes of formation of its teach are executed in an analogous way, similarly to the direct feed of the material.

Figure 18:
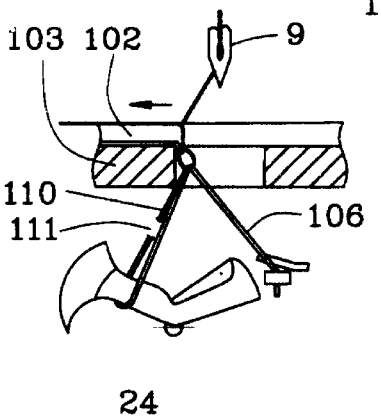
FIG. 18 shows a process of cutting off of the bottom thread.
Figure 19:
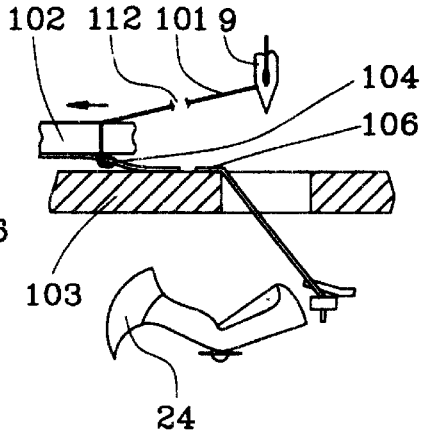
FIG. 19 is a view showing the process of removal of material from under the needle and cutting off of the top thread.
Figure 20:
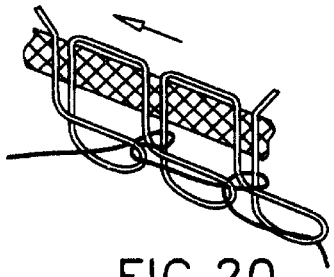
FIG. 20 shows a structure of the obtained double-thread stitch line in a perspective.

After the process of sewing or during a transition to another operation, it is necessary to remove the material from below the needle, and during this after the removal of the material, the bottom thread must remain on the upper part of the needle plate 103 so as to prevent a new threading of the bottom thread 106. For this purpose, the sewing machine is stopped in a position (FIG. 18) when the processes of transportation of the material and tightening of the top thread are finished, the looper 24 engages the bottom thread 106 and expands the loop 110 of the bottom thread 106, and the needle 9 does not yet enter the material 102. First of all, with a special device of the sewing machine, the branch of the loop 110 of the bottom thread 106 is cut off under the needle plate 103 at the location 111. After this, the pressing leg 62 (FIG. 1) is lifted, and simultaneously the top thread 101 is released from the tensioning device, and after this the material 102 is removed from under the needle 9, and the cutting off of the top thread 101 at the location 112 is executed (FIG. 19) therefore the bottom thread 106 remains on the surface of the needle plate 103 in order to continue the operation, while the remaining part of the bottom thread on the material 102 becomes surrounded by the loop 104 of the top thread 101. Thereby the obtained double-thread stitch line (FIG. 20) does not unravel from the end of the line even when a force is applied.

I claim:

1. Double-thread chain-stitch sewing machine with a platform containing a needle, a needle plate with a slot, a pressing leg, a looper and a toothed rack for transporting a material, characterized in that it additionally has autonomous disk-shaped cam thread tensioners for a top and a bottom thread and a pusher for the bottom thread installed for executing an oscillating movement around its axis, and the looper is installed for executing a rotary movement in a vertical plane, parallel to the stitch line and performing two revolutions per one cycle of movement of the needle and pusher.

2. A sewing machine in accordance with claim 1, characterized in that the platform is formed columnar.

3. A sewing machine as defined in claim 1, characterized in that the platform is formed cylindrical.

4. A method of obtaining a double-thread stitch line by forming stitches which are successively arranged on upper and lower surfaces of a material to be sewn, during movement of the material and passing through it of a top thread by a needle with formation of a loop-overlap, characterized in that during the formation of each stitch after the formation of the loop-overlap, the latter is engaged by a rotatable looper in a beginning of its first revolution of a first cycle, then the engaged loop-overlap is expanded and turned by 180°, and during this the bottom thread is passed through a thread guide located in a first quadrant of a circular trajectory of a nose of the looper with an exit of an end of the bottom thread through the slot of the needle plate to its upper surface, then the bottom thread is supplied by an oscillating pusher above the needle thread in a direction toward the nose of the looper across the plane of its rotation to intersect this plane by a branch of the bottom thread, and at the end of the first rotation of the looper, the latter engages the branch of the bottom thread and starts moving the material, then in the beginning of a second revolution of the looper the latter is introduced into the loop-overlap of the top thread which is held by a body of the looper, while the bottom thread with a front part of the pusher which moves at this moment in a reverse direction is moved out by the looper, and after this the loop-overlap of the top thread is thrown off from the looper and is passed the previously engaged branch of the bottom thread into the thrown off loop-overlap of the top thread, and the top thread is reduced, and then tightened by a disk-shaped cam thread loop which is necessary for moving it around the looper, and the loop of the bottom thread during the second revolution of the looper is continued to expand and turn by 180°, so as to pierce by the needle through the material, pass through it the top thread and in the middle of the second revolution of the looper the needle with the top thread is moved from a side of approach of the nose of the looper to the loop of the bottom thread which is held by the body of the looper, at the end of the second revolution of the looper of the latter engages the loop-overlap of the top thread formed by the needle, and then in the beginning of the first revolution of the second cycle of the looper the latter is introduced into the loop of the bottom thread held by a bottom of the looper, and after this the latter is thrown off from the looper, and the previously engaged loop-overlap of the top thread is passed into the thrown off loop of the bottom thread and the latter is reduced, and then tightened by a disk-shaped cam thread tensioner for the lower thread.

* * * * *